US006984933B2

(12) United States Patent
Takenaka et al.

(10) Patent No.: US 6,984,933 B2
(45) Date of Patent: Jan. 10, 2006

(54) SPECIFICALLY LOCATED SPACER SUPPORTS

(75) Inventors: Shigeo Takenaka, Minato-ku (JP); Satoshi Ishikawa, Minato-ku (JP); Masaru Nikaido, Minato-ku (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/001,300

(22) Filed: Dec. 2, 2004

(65) Prior Publication Data

US 2005/0116613 A1 Jun. 2, 2005

Related U.S. Application Data

(63) Continuation of application No. PCT/JP03/06946, filed on Jun. 2, 2003.

(30) Foreign Application Priority Data

Jun. 4, 2002 (JP) ..... 2002-162864

(51) Int. Cl.
*H01J 1/62* (2006.01)

(52) U.S. Cl. ..... 313/495; 313/292

(58) Field of Classification Search ..... 313/495, 313/238, 250, 252, 254, 256, 258, 292
See application file for complete search history.

(56) References Cited

U.S. PATENT DOCUMENTS 6,144,153 A * 11/2000 Nakatani ..... 313/495

FOREIGN PATENT DOCUMENTS

| | | |
|---|---|---|
| EP | 1189255 A1 | 3/2002 |
| JP | 2000-208032 A | 7/2000 |
| JP | 2000-251806 A | 9/2000 |

* cited by examiner

*Primary Examiner*—Vip Patel
(74) *Attorney, Agent, or Firm*—Oblon, Spivak, McClelland, Maier & Neustadt, P.C.

(57) ABSTRACT

A plurality of independent spacers are arranged between a first substrate provided with an image display surface having a plurality of phosphor layers corresponding to pixels, individually, and a second substrate provided with a plurality of electron sources which excite the phosphor layers, individually. Each of the spacers is located so that a center thereof is situated off a straight line which connects respective pixel centers of two adjacent phosphor layers.

13 Claims, 3 Drawing Sheets

SPECIFICALLY LOCATED SPACER SUPPORTS

CROSS-REFERENCE TO RELATED APPLICATIONS

This is a Continuation Application of PCT Application No. PCT/JP03/06946, filed Jun. 2, 2003, which was published under PCT Article 21(2) in Japanese.

This application is based upon and claims the benefit of priority from prior Japanese Patent Application No. 2002-162864, filed Jun. 4, 2002, the entire contents of which are incorporated herein by reference.

BACKGROUND OF THE INVENTION

1. Field of the Invention

This invention relates to an image display device having substrates opposed to each other and a plurality of electron sources arranged on the inner surface of one of the substrates.

2. Description of the Related Art

In recent years, there have been demands for image display devices for high-grade broadcasting or high-resolution versions therefor, which require stricter screen display performance. To meet these demands, the screen surface must be flattened and enhanced in resolution. At the same time, the devices must be lightened in weight and thinned.

Flat image display devices, such as a field emission display (hereinafter referred to as FED), are promising as image display devices that fulfill the above requirements. The FED has a first substrate and a second substrate that are opposed to each other with a given gap between them. These substrates have their respective peripheral edge portions joined together directly or by a sidewall in the form of a rectangular frame, thereby constituting a vacuum envelope. Phosphor layers are formed on the inner surface of the first substrate. A plurality of electron emitting elements for use as electron sources that excite the phosphor layers to luminescence are provided on the inner surface of the second substrate.

A plurality of spacers for use as support members are arranged between the first and second substrates in order to support the atmospheric load that acts on these substrates. In displaying an image on this FED, an anode voltage is applied to the phosphor layers, and electron beams emitted from the electron emitting elements are accelerated and run against the phosphor layers by the anode voltage. Thereupon, the phosphors glow and display the image.

According to the FED of this type, the size of each electron emitting element is on the micrometer order, and the distance between the first substrate and the second substrate can be set on the millimeter order. Thus, this image display device, compared with a cathode ray tube (CRT) that is used as a display of an existing TV or computer, can achieve higher resolution, lighter weight, and reduced thickness.

In order to obtain practical display characteristics, in the image display device of the type described above, the anode voltage should preferably be set to several kilovolts or more with use of phosphors that are similar to those of a conventional cathode ray tube. In view of the resolution and the properties and manufacturability of the support members, however, the gap between the first and second substrates cannot be made very wide and must be set to 1 to 2 mm or thereabouts. When electrons that have high acceleration voltage run against the phosphor surface, moreover, secondary electrons and reflected electrons are generated on the phosphor surface.

If the space between the first substrate and the second substrate is narrow, the secondary electrons and the reflected electrons that are generated on the phosphor surface run against the spacers between the substrates, so that the spacers are charged with electricity. With the acceleration voltage of the FED, the spacers are charged positively, in general. In this case, the electron beams emitted from the electron emitting elements are attracted to the spacers and deflected from their original paths. In consequence, the electron beams are mislanded on the phosphor layers, so that the color purity of the displayed image lowers inevitably.

BRIEF SUMMARY OF THE INVENTION

This invention has been made in consideration of these circumstances, and its object is to provide an image display device, capable of reducing electron beam path deflection and ensuring improved image quality.

According to an aspect of the invention, an image display device comprises: a first substrate provided with an image display surface having a plurality of phosphor layers corresponding to pixels, individually; a second substrate opposed to the first substrate with a gap and provided with a plurality of electron sources which excite the phosphor layers, individually; and a plurality of independent spacers which are arranged between the first substrate and the second substrate and maintain the gap between the first and second substrates. Each of the spacers is arranged so that a center thereof is situated off a straight line which connects respective pixel centers of two adjacent phosphor layers.

According to another aspect of the invention, an image display device comprises: a first substrate provided with an image display surface having a plurality of phosphor layers; a second substrate opposed to the first substrate across a gap; a plurality of electron sources which are provided on the second substrate so as to correspond to one pixel each and excite the phosphor layers, individually; and a plurality of independent spacers which are arranged between the first substrate and the second substrate and maintain the gap between the first and second substrates, each of the spacers being located so that a center thereof is situated off a straight line which connects respective centers of two adjacent electron sources.

According to another aspect of the invention, an image display device comprises: a first substrate provided with an image display surface having a plurality of phosphor layers corresponding to pixels, individually; a second substrate opposed to the first substrate with a gap and provided with a plurality of electron sources which excite the phosphor layers, individually; a plate-like grid having a plurality of apertures corresponding individually to the phosphor layers and provided between the first and second substrates; and a plurality of independent spacers which are arranged between the first and second substrates and maintain the gap between the first and second substrates, each of the spacers being located so that a center thereof is situated off a straight line which connects respective centers of two adjacent apertures of the grid.

According to the image display device constructed in this manner, each of the spacers is located so that the center thereof is situated off the straight line which connects the respective pixel centers of two adjacent phosphor layers. Therefore, a force of attraction from the spacers that acts on electron beams lessens. Thus, the amount of movement of the electron beams attributable to the force of attraction from the spacers can be reduced, so that miss-landing of the electron beam on a plural phosphor layers can be lessened. In consequence, degradation of color purity can be reduced to obtain the image display device that ensures improved image quality.

DETAILED DESCRIPTION OF THE INVENTION

Embodiments in which this invention is applied to a surface-conduction electron emission display (hereinafter referred to as SED) for use as a flat image display device will now be described in detail with reference to the drawings.

Figure 1:
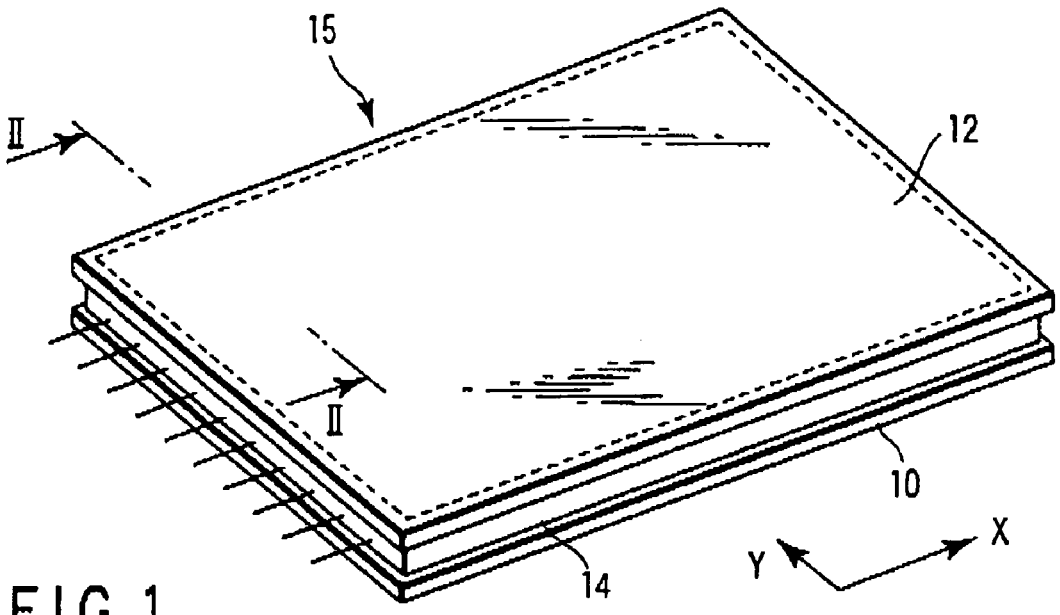
FIG. 1 is a perspective view showing an SED according to an embodiment of this invention.
Figure 2:
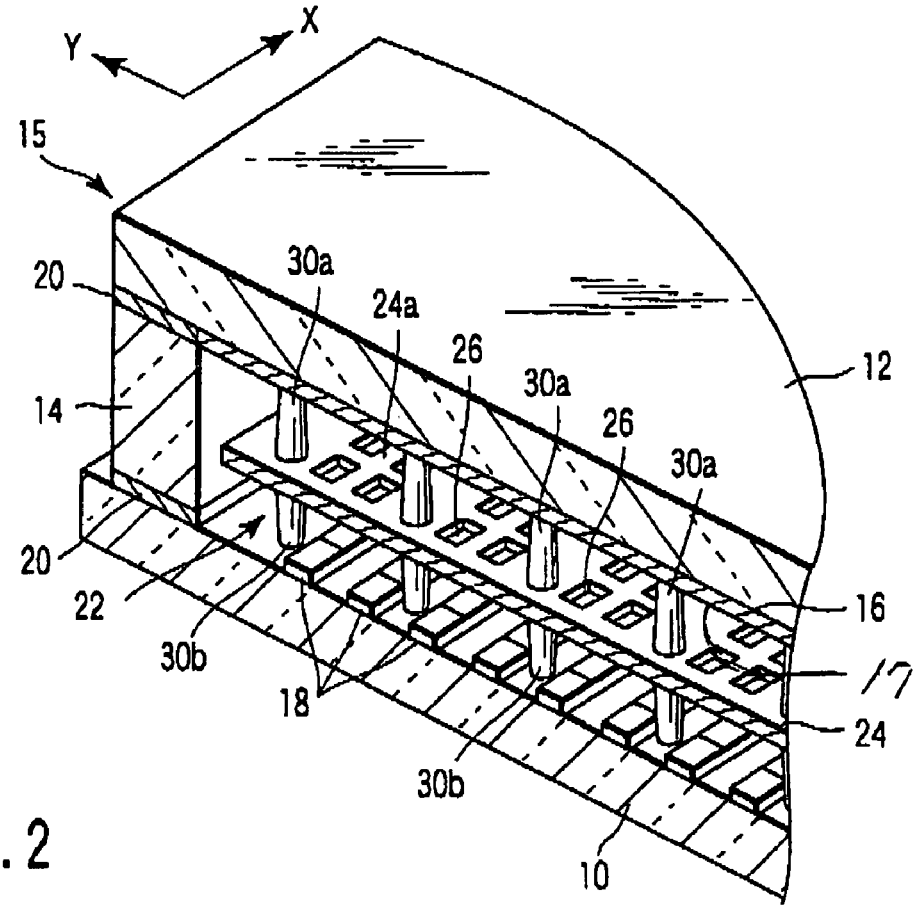
FIG. 2 is a perspective view of the SED, cut along line II—II of FIG. 1.
Figure 3:
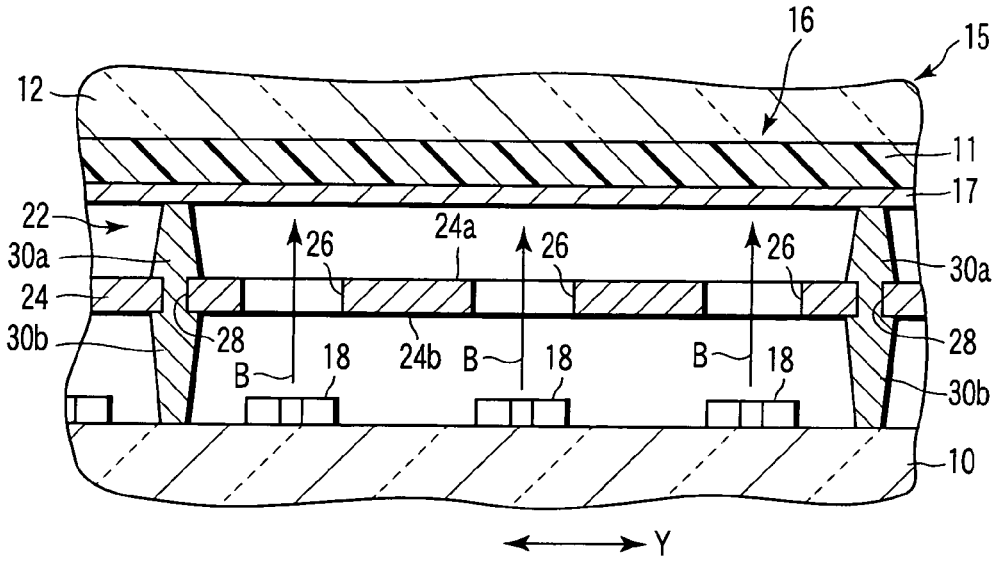
FIG. 3 is an enlarged sectional view of a part of the SED taken in a Y-direction.

As shown in FIGS. 1 to 3, the SED comprises a first substrate 12 and a second substrate 10, which are formed of a rectangular glass as a transparent insulating substrate each. These substrates are opposed to each other with a gap of about 1.0 to 2.0 mm between them. The second substrate 10 is formed having a size a little greater than that of the first substrate 12. The second substrate 10 and the first substrate 12 have their respective peripheral edge portions joined together by a glass sidewall 14 in the form of a rectangular frame, and constitute a flat, rectangular vacuum envelope 15. The vacuum envelope 15 is kept at a high vacuum of about $10^{-4}$ Pa inside.

A phosphor screen 16 that constitutes an image display surface is formed on the inner surface of the first substrate 12. The phosphor screen 16 is formed by arranging phosphor layers R, G and B, which emit light of red, blue, and green, respectively, as they are hit by electrons, and a black light shielding layer 11. The phosphor layers R, G and B are in the form of stripes or dots. A metal back 17 of aluminum or the like is formed on the phosphor screen 16. A transparent electrically conductive film or color filter film of, for example, ITO (indium tin oxide) may be provided between the first substrate 12 and the phosphor screen.

A large number of surface-conduction electron emitting elements 18 are provided on the inner surface of the second substrate 10. They individually emit electron beams as electron sources that excite the phosphor layers of the phosphor screen 16. These electron emitting elements 18 are arranged in a plurality of columns and a plurality of rows corresponding to individual pixels. Each electron emitting element 18 is formed of an electron emitting portion (not shown), a pair of element electrodes that apply voltage to the electron emitting portion, etc. A large number of wires (not shown) for applying voltage to the electron emitting elements 18 are formed in a matrix on the second substrate 10.

According to the present embodiment, each of the phosphor layers R, G and B corresponds to one pixel. Likewise, each of the electron emitting elements 18 corresponds to one pixel.

The sidewall 14 that serves as a joining member is sealed to the respective peripheral edge portions of the second substrate 10 and the first substrate 12 with a sealant 20 of, for example, low-melting glass or low-melting metal, and joins the first and second substrates together.

As shown in FIGS. 2 and 3, the SED comprises a spacer assembly 22 that is located between the second substrate 10 and the first substrate 12. In the present embodiment, the spacer assembly 22 is provided with a plate-like grid 24 and a plurality of columnar spacers that are set up integrally on the opposite sides of the grid.

More specifically, the grid 24 has a first surface 24*a* opposed to the inner surface of the first substrate 12 and a second surface 24*b* opposed to the inner surface of the second substrate 10, and is located parallel to those substrates. A large number of electron beam passage apertures 26 and a plurality of spacer openings 28 are formed in the grid 24 by etching or the like. The electron beam passage apertures 26, which function as apertures of this invention, are arranged opposite the electron emitting elements 18, individually. The spacer openings 28 are located individually between the electron beam passage apertures and arranged at given pitches.

The grid 24 is formed of a sheet of iron-nickel metal with a thickness of 0.1 to 0.2 mm, for example. The grid 24 is oxidation-treated so that a blackened film of the elements of the metal sheet that forms the grid, e.g., $Fe_3O_4$ and $Fe_2NiO_4$, is formed on the surface of the grid. Further, the surface of the grid 24 formed having a high-resistance film that is obtained by spreading and firing a high-resistance substance formed of glass and ceramics. The resistance of the high-resistance is set to E+8Ω/□ or more.

Each electron beam passage aperture 26 has a rectangular form measuring 0.15 to 0.25 mm by 0.15 to 0.25 mm, for example. Each spacer opening 28 has a diameter of about 0.2 to 0.5 mm, for example. The aforesaid high-resistance film is also formed on the wall surface of each electron beam passage aperture 26.

A first spacer 30*a* is set up integrally on the first surface 24*a* of the grid 24, overlapping each corresponding spacer opening 28. The extended end of each first spacer 30*a* abuts against the inner surface of the first substrate 12 via the metal back 17 and the black light shielding layer 11 of the phosphor screen 16. A second spacer 30*b* is set up integrally on the second surface 24*b* of the grid 24, overlapping each corresponding spacer opening 28, and its extended end abuts against the inner surface of the second substrate 10. Each spacer opening 28 and the first and second spacers 30*a* and 30*b* are situated coaxially with one another, and the first and second spacers are coupled integrally to each other through the spacer opening 28. Thus, the first and second spacers 30*a* and 30*b* are formed integrally with the grid 24 in a manner such that the grid 24 is sandwiched from both sides between them.

Each of the first and second spacers 30*a* and 30*b* is tapered so that its diameter is reduced from the side of the grid 24 toward the extended end. For example, each first spacer 30*a* is formed so that the diameter of its proximal end on the side of the grid 24 is about 0.4 mm, the diameter of its extended end is about 0.3 mm, and its height is about 0.4 mm. Each second spacer 30*b* is formed so that the diameter of its proximal end on the side of the grid 24 is about 0.4 mm, the diameter of its extended end is about 0.25 mm, and its height is about 1.0 mm. Thus, the height of the second spacer 30*b* is greater than the height of the first spacer 30*a*, and is set to be about 4/3 or more times as great as the height of the first spacer, preferably two or more times.

As shown in FIGS. 2 and 3, the spacer assembly 22 is located between the first substrate 12 and the second substrate 10. As the first and second spacers 30*a* and 30*b* engage the respective inner surfaces of the first substrate 12 and the second substrate 10, they support atmospheric load that acts on these substrates, thereby maintaining the distance between the substrates at a given value.

The SED is provided with a voltage supply unit (not shown) that applies voltages to the grid 24 and the metal back 17 of the first substrate 12. This voltage supply unit is connected to the grid 24 and the metal back 17, and applies voltages of, for example, 12 kV and 10 kV to the grid 24 and the metal back 17, respectively.

In displaying an image on the SED constructed in this manner, an anode voltage is applied to the phosphor screen 16 and the metal back 17, and electron beams B emitted from the electron emitting elements 18 are accelerated and run against the phosphor screen 16 by the anode voltage. Thereupon, the phosphor layers of the phosphor screen 16 are excited to emit light, and the image is displayed.

The following is a detailed description of layout relations between the phosphor layers, electron emitting elements, and spacers.

Figure 4:
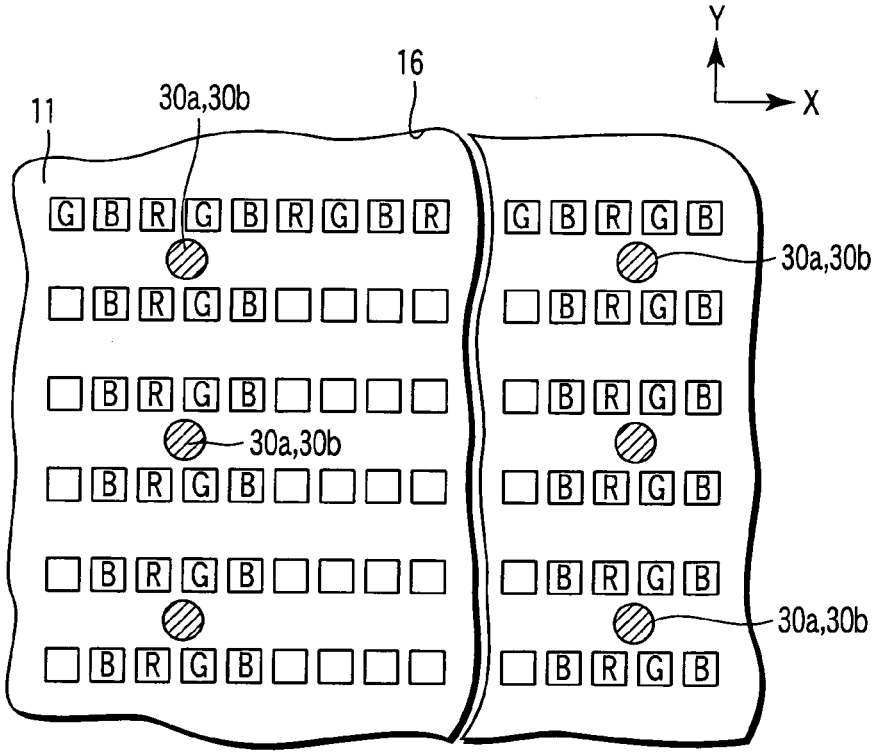
FIG. 4 is a plan view showing layout relations between phosphor layers and spacers of the SED.

If the longitudinal and crosswise directions of the second substrate 10 and the first substrate 12 are an X-direction (first direction) and a Y-direction (second direction), respectively, as shown in FIGS. 2 to 4, the electron emitting elements 18 on the second substrate 10 are arranged at given pitches in the X- and Y-directions, individually. The electron beam passage apertures 26 in the grid 24 are also arranged at the same pitches as the electron emitting elements 18 in the X- and Y-directions, and are opposed to the electron emitting elements 18, individually.

Figure 5:
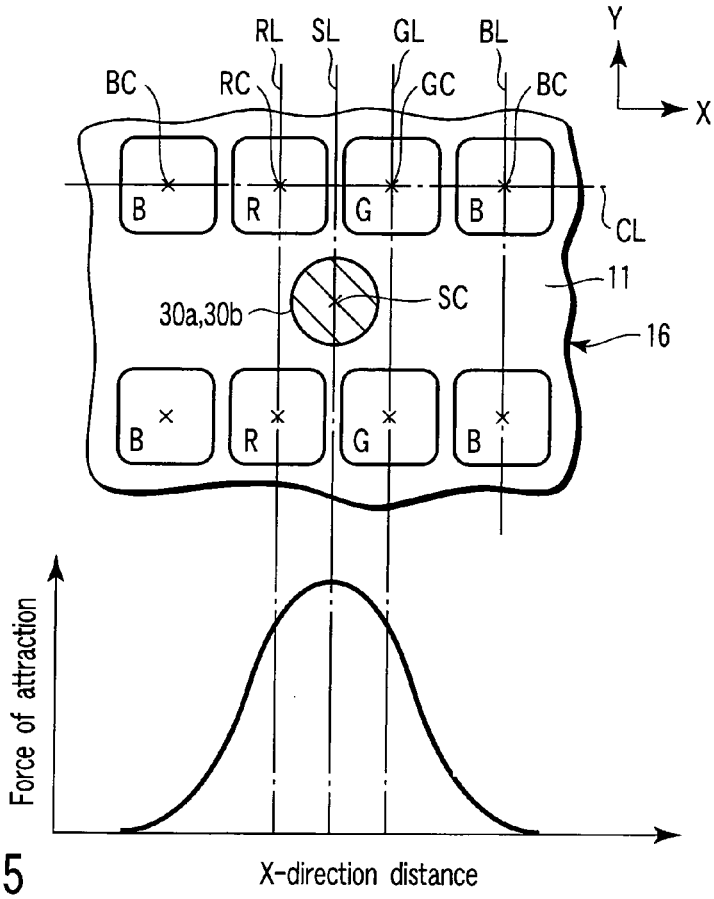
FIG. 5 combines an enlarged plan view showing some of the phosphor layers and a part of a spacer and a diagram showing the relation between the force of attraction of the spacer and X-direction distance.

As shown in FIGS. 4 and 5, each of the phosphor layers R, G and B of the phosphor screen 16 on the first substrate 12 is formed having a substantially rectangular shape corresponding to each electron beam passage aperture 26 of the grid 24. The phosphor layers R, G and B of three colors, red, green, and blue, are arranged alternately at given pitches in the X-direction. In this case, the red phosphor layers R and the green phosphor layers G are arranged adjacent to one another. The phosphor layers of the same color are arranged at given pitches in the Y-direction. Each of the phosphor layers R. G and B forms a phosphor pixel. The black light shielding layer 11 is formed so as to fill gaps between the phosphor layers R, G and B.

The electron emitting elements 18 are arranged substantially at the same pitches as the aforesaid phosphor layers in the X- and Y-directions, and are opposed individually to their corresponding phosphor layers through the electron beam passage apertures 26 of the grid 24.

On the other hand, the first and second spacers 30*a* and 30*b* are arranged in the Y- and X-directions at pitches that are a plurality of times as long as those of the phosphor layers R, G and B. The first and second spacers 30*a* and 30*b* are discretely arranged substantially covering the whole area of the phosphor screen 16. Each of the first and second spacers 30*a* and 30*b* is situated opposite the black light shielding layer 11 and between phosphor layers that adjoin each other in the Y-direction.

Each of the first and second spacers 30*a* and 30*b* is located so that its center SC is situated off a straight line that connects the respective pixel centers of two adjacent phosphor layers. The straight line that connects the pixel centers implies a straight line of which the opposite ends are situated on the respective pixel centers of the phosphor layers.

In the present embodiment, the first and second spacers 30*a* and 30*b* are arranged so that their center SC lies on neither of straight lines RL, GL and BL that pass through respective pixel centers RC, GC and BC of the phosphor layers R, G and B and extend parallel to the Y-direction and are deviated in the X-direction from the straight lines RL, GL and BL.

If a centerline that passes through the respective pixel centers of two adjacent phosphor layers is CL, in other words, the first and second spacers 30*a* and 30*b* are arranged so that two straight lines that pass through the pixel centers of the two phosphor layers and extend at right angles to the centerline CL never overlap the center SC of the spacers, that is, the center SC is situated off the two straight lines.

The first and second spacers 30*a* and 30*b* are arranged so that their center SC is situated substantially halfway between the straight lines RL and GL that pass through the respective pixel centers RC and GC of the two phosphor layers R and G that adjoin in the X-direction.

As mentioned before, the phosphor layers of the phosphor screen 16, the electron beam passage apertures 26 of the grid 24, and the electron emitting elements 18 are located opposite one another, and have equivalent array patterns. Thus, the first and second spacers 30*a* and 30*b* are arranged in the same positional relation to the electron beam passage apertures 26 of the grid 24 and the electron emitting elements 18 as the aforesaid positional relation to the phosphor layers.

More specifically, each of the first and second spacers 30*a* and 30*b* is located so that its center SC is situated off a straight line that connects the respective centers of two adjacent electron emitting elements 18 and that its center SC is situated off a straight line that connects the respective centers of two adjacent electron beam passage apertures of the grid 24. In the present embodiment, each of the first and second spacers 30*a* and 30*b* is located to prevent its center SC from overlapping a centerline that passes through the respective centers of two adjacent electron emitting elements 18 and two straight lines that extend individually at right angles to the central axis and pass through the respective centers of those two electron emitting elements 18.

In manufacturing the spacer assembly 22 constructed in this manner, the grid 24 of a given size and first and second dies (not shown), each in the form of a rectangular plate having substantially the same size as the grid, are prepared first. The electron beam passage apertures 26 and the spacer openings 28 are previously formed in the grid 24 by etching. Thereafter, the whole grid is oxidized by an oxidation treatment so that an insulating film is formed on the grid surface including the respective inner surfaces of the electron beam passage apertures 26 and the spacer openings 28. Further, a dispersion of fine particles of tin oxide and antimony oxide is sprayed on the insulating film, dried, and fired to form the high-resistance film.

A plurality of through holes corresponding to the spacer openings 28 of the grid 24 are formed in each of the first and second dies. The first die is formed by laminating a plurality of thin metal sheets, e.g., three in number. Each thin metal sheet is composed of an iron-based metal sheet with a thickness of 0.25 to 0.3 mm, which is formed having a plurality of tapered through holes. The through holes formed in each of the thin metal sheets have a diameter different from those of the through holes in the other thin metal sheets. These three thin metal sheets are laminated in a manner such that the through holes are aligned substantially coaxially and arranged in the descending order of diameter, and are diffusion-bonded to one another in a vacuum or a reducing atmosphere. Thus, a first die 32 with a thickness of 1.25 to 1.5 mm as a whole is formed, and each through hole is defined by joining three through holes together so that it has a stepped tapered inner peripheral surface.

The second die, like the first die, is formed by laminating, for example, two thin metal sheets, and each through hole in the second die is defined by joining two tapered through holes together so that it has a stepped tapered inner peripheral surface.

The inner peripheral surface of each through hole 34 of the first and second dies is coated with a resin that thermally decomposes at a lower temperature than an organic component of a spacer forming material (mentioned later) does.

In spacer assembly manufacturing processes, the first die is brought intimately into contact with the first surface 24*a* of the grid 24 so that the large-diameter side of each through hole is situated on the side of the grid 24, and positioned so that the through holes are aligned individually with the spacer openings 28 of the grid. Likewise, the second die is brought intimately into contact with the second surface 24*b* of the grid 24 so that the large-diameter side of each through hole is situated on the side of the grid 24, and positioned so that the through holes are aligned individually with the spacer openings 28 of the grid. The first die, grid 24, and second die are fixed to one another by using a clamper (not shown) or the like.

Then, a pasty spacer forming material is supplied, for example, from the outer surface side of the first die, and the through holes of the first die, the spacer openings 28 of the grid 24, and the through holes of the second die are filled with the spacer forming material. A glass paste that contains at least an ultraviolet-curing binder (organic component) and a glass filler is used as the spacer forming material.

Subsequently, ultraviolet (UV) rays are applied as radiation to the filled spacer forming material from the outer surface side of the first and second dies, whereby the spacer forming material is UV-cured. Thereafter, thermal curing may be performed as required. Then, the resin that is spread on each through hole of the first and second dies is thermally decomposed by heat treatment to form gaps between the spacer forming material and the dies, and the first and second dies are separated from the grid 24.

Subsequently, the grid 24 loaded with the second die is heat-treated in a heating oven, whereby the binder is removed from the spacer forming material. Thereafter, the spacer forming material is regularly fired at about 500 to 550° C. for 30 minutes to one hour. Thereupon, a base of the spacer assembly 22, which has the first and second spacers 30*a* and 30*b* built-in, is completed on the grid 24.

If electron beams are emitted from the electron emitting elements 18 toward the phosphor screen 16 for image display, according to the SED constructed in this manner, those electron beams which pass near the first and second spacers 30*a* and 30*b* tend to be attracted toward the first and second spacers under the influence of charging of the spacers. As shown in FIG. 5, in this case, a force of attraction in the Y-direction from the first and second spacers 30*a* and 30*b* that acts on the electron beams is maximized on a straight line SL that passes through the center SC of the first and second spacers 30*a* and 30*b* and extend in the Y-direction.

According to the present embodiment, however, the center SC of the first and second spacers 30*a* and 30*b* is situated off the straight lines RL and GL that pass through the pixel centers RC and GC of the two phosphor layers R and G adjoining in the X-direction, respectively. In other words, the phosphor layers R and G have their respective pixel centers RC and GC off the straight line SL. Accordingly, the electron beams that are emitted from the electron emitting elements 18 toward the pixel centers of the phosphor layers also pass through regions that are distant from the straight line SL, so that the force of attraction from the first and second spacers 30*a* and 30*b* that acts on the electron beams lessens. Thus, the amount of movement of the electron beams attributable to the force of attraction from the first and second spacers 30*a* and 30*b* can be reduced, so that miss-landing of electron beams on the phosphor screen can be lessened. In consequence, degradation of color purity can be reduced to obtain an SED that ensures improved image quality.

In the present embodiment, the first and second spacers 30*a* and 30*b* are provided between the red phosphor layers R and the green phosphor layers G. If the electron beams around the phosphor layers R and G are moved by the force of attraction from the first and second spacers 30*a* and 30*b*, therefore, the displayed image is cyan. In this case, it is hard for an observer's visual sense to discriminate cyan, so that substantial degradation of color purity cannot easily occur. Thus, an SED that ensures further improved image quality can be obtained.

According to the arrangement described above, if any of the spacer forming material filled in the dies oozes out to the grid surface side in a spacer forming process, blocking of the electron beam passage apertures 26 by the spacer forming material can be reduced, which provides an advantage in terms of manufacturing processes.

According to the SED of the present embodiment, the surface resistance of the second spacers 30*b* on the side of the electron emitting elements 18 is set to be lower than the surface resistance of the first spacers 30*a*. Thus, charging of the second spacers 30*b* can be reduced, so that deflection of electron beams attributable to the charging of the second spacers can be lessened. In consequence, an image with further improved color purity can be displayed.

According to the SED described above, moreover, the grid 24 is located between the first substrate 12 and the second substrate 10, and the height of the first spacers 30*a* is lower than the height of the second spacers 30*b*. Accordingly, the grid 24 is situated closer to the first substrate 12 than to the second substrate 10. Even if electric discharge occurs from the side of the first substrate 12, therefore, the grid 24 can restrain the electron emitting elements 18 on the second substrate 10 from being broken by electric discharge. Thus, an SED can be obtained that is highly resistant to discharge voltage and ensures improved image quality.

This invention is not limited to the embodiment described above, and various modifications may be effected without departing from the scope of the invention. Although each of the first and second spacers 30*a* and 30*b* is provided between a red phosphor layer R and a green phosphor layer G, for example, they may alternatively be situated between another two adjacent phosphor layers, e.g., a phosphor layer G and a phosphor layer B. Also in this case, the amount of movement of the electron beams attributable to the force of attraction from the spacers can be reduced, so that the image quality can be improved.

In the foregoing embodiment, moreover, the phosphor layers of the individual colors are arranged alternately in the X-direction, and the phosphor layers of each same color are arranged in the Y-direction. If necessary, however, they may be arranged in an alternative form. Likewise, the longitudinal and crosswise directions of the second substrate 10 and the first substrate 12 are supposed to be the X-direction and the Y-direction, respectively, according to the foregoing embodiment. In contrast with this, however, the longitudinal and crosswise directions may be supposed to be Y- and X-directions, respectively.

Figure 6:
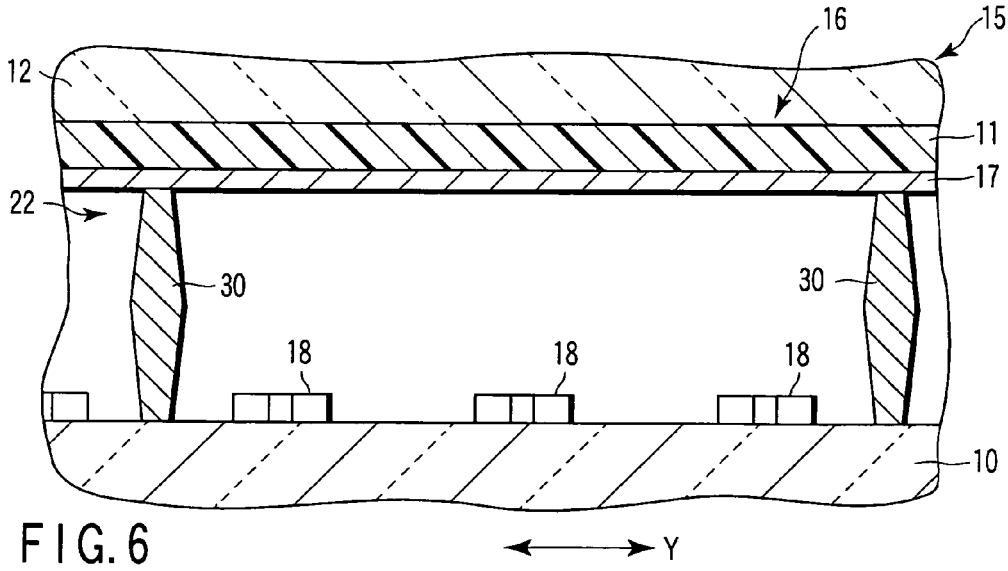
FIG. 6 is an enlarged sectional view of a part of an SED according to another embodiment of this invention taken along a Y-direction.

Further, this invention may be also applied to an image display device that has no grid. According to an SED shown in FIG. 6, each spacer 30 is formed having a columnar shape and located between a second substrate 10 and a first substrate 12. The spacers 30 are arranged in the same manner as in the foregoing embodiment with respect to phosphor layers R, G and B of a phosphor screen 16 and electron emitting elements 18. In the SED constructed in this manner, moreover, a large number of spacers 30 that are formed independently in advance in a column each are arranged in a predetermined array by means of an arranging machine (not shown) and fixed to the second substrate 10 and/or the first substrate 12 with an inorganic adhesive.

Other configurations of the SED according to the foregoing embodiment are shared in common. Therefore, like reference numerals are used to designate like portions, and a detailed description of those portions is omitted. The SED of the above construction can provide the same functions and effects of the SED according to the foregoing embodiment.

In this invention, the electron sources are not limited to surface-conduction electron emitting elements, and may be selected among various types, including the field emission type, carbon nanotubes, etc. Further, this invention is not limited to the SED described above, and is also applicable to various image display devices, such as an FED, plasma display, etc.

What is claimed is:

1. An image display device comprising:

a first substrate provided with an image display surface having a plurality of phosphor layers of different colors corresponding to pixels, individually, the phosphor layers of individual colors being arranged alternately in a first direction and the phosphor layers of a same color being arranged in a second direction perpendicular to the first direction;

a second substrate opposed to the first substrate with a gap and provided with a plurality of electron sources which excite the phosphor layers, individually; and a plurality of independent spacers which are arranged between the first substrate and the second substrate and maintain the gap between the first and second substrates, each of the spacers being located so that a center thereof is situated off a centerline which passes through respective pixel centers of two phosphor layers adjoining in the first direction and two straight lines which pass through the respective pixel centers of the two adjacent phosphor layers and extend in the second direction.

2. The image display device according to claim 1, wherein each of the spacers is arranged so that the center thereof is situated substantially halfway between the two straight lines which pass through the respective pixel centers of the two phosphor layers adjoining in the first direction and extend in the second direction.

3. The image display device according to claim 1, wherein one of the phosphor layers adjoining in the first direction is a red light phosphor layer, and the other is a green light phosphor layer.

4. The image display device according to claim 1, wherein the spacer is substantially columnar.

5. An image display device comprising:

a first substrate provided with an image display surface having a plurality of phosphor layers corresponding to pixels, individually;

a second substrate opposed to the first substrate with a gap and provided with a plurality of electron sources which excite the phosphor layers, individually; and a plurality of independent spacers which are arranged between the first substrate and the second substrate and maintain the gap between the first and second substrates, each of the spacers being located so that a center thereof is situated off a centerline which passes through respective pixel centers of two adjacent phosphor layers and two straight lines which pass through the respective pixel centers of the two adjacent phosphor layers and extend at right angles to the centerline.

6. An image display device comprising:

a first substrate provided with an image display surface having a plurality of phosphor layers;

a second substrate opposed to the first substrate across a gap;

a plurality of electron sources which are provided on the second substrate so as to correspond to one pixel each and excite the phosphor layers, individually; and a plurality of independent spacers which are arranged between the first substrate and the second substrate and maintain the gap between the first and second substrates, each of the spacers being located so that a center thereof is situated off a centerline which passes through respective centers of two adjacent electron sources and two straight lines which pass through the respective centers of the two adjacent electron sources and extend at right angles to the centerline.

7. An image display device comprising:

a first substrate provided with an image display surface having a plurality of phosphor layers of different colors, corresponding to pixels, individually, the phosphor layers of the individual colors being arranged alternately in a first direction and the phosphor layers of a same color being arranged in a second direction perpendicular to the first direction;

a second substrate opposed to the first substrate with a gap and provided with a plurality of electron sources which excite the phosphor layers, individually;

a plate-like grid having a plurality of apertures corresponding individually to the phosphor layers and provided between the first and second substrates; and a plurality of independent spacers which are arranged between the first and second substrates and maintain the gap between the first and second substrates, each of the spacers being located so that a center thereof is situated off a centerline which passes through respective pixel centers of two phosphor layers adjoining in the first direction and two straight lines which pass through the respective pixel centers of the two adjacent phosphor layers and extend in the second direction.

8. The image display device according to claim 7, wherein each of the spacers is arranged so that the center thereof is situated substantially halfway between the two straight lines which pass through the respective pixel centers of the two phosphor layers adjoining in the first direction and extend in the second direction.

9. The image display device according to claim 7, wherein one of the phosphor layers adjoining in the first direction is a red light phosphor layer, and the other is a green light phosphor layer.

10. The image display device according to claim 7, wherein the grid has a first surface opposed to the first substrate and a second surface opposed to the second substrate, and the spacers include a plurality of columnar first spacers set up on the first surface of the grid and in contact with the first substrate and a plurality of columnar second spacers set up on the second surface of the grid and in contact with the second substrate.

11. The image display device according to claim 10, wherein each of the first spacers is coaxial with each corresponding second spacer, individually.

12. The image display device according to claim 11, wherein the first and second spacers are coupled to one another through spacer openings in the grid.

13. An image display device comprising:

a first substrate provided with an image display surface having a plurality of phosphor layers corresponding to pixels, individually;

a second substrate opposed to the first substrate with a gap and provided with a plurality of electron sources which excite the phosphor layers, individually;

a plate-like grid having a plurality of apertures corresponding individually to the phosphor layers and provided between the first and second substrates; and a plurality of independent spacers which are arranged between the first and second substrates and maintain the gap between the first and second substrates, each of the spacers being located so that a center thereof is situated off a centerline which passes through respective pixel centers of two adjacent phosphor layers and two straight lines which pass through the respective pixel centers of the two adjacent phosphor layers and extend at right angles to the centerline.

* * * * *